United States Patent [19]

Bodine et al.

[11] Patent Number: 4,522,271

[45] Date of Patent: Jun. 11, 1985

[54] METHOD AND APPARATUS FOR DAMPING VIBRATIONS IN DRILL COLLAR STRINGS

[76] Inventors: Albert G. Bodine; James N. Gregory, both of 7787 Woodley Ave., Van Nuys, Calif. 91406

[21] Appl. No.: 542,456

[22] Filed: Oct. 17, 1983

[51] Int. Cl.[3] ..... E21B 17/16

[52] U.S. Cl. ..... 175/56; 175/320

[58] Field of Search ..... 175/56, 57, 320, 321, 175/293; 74/574; 464/180, 183; 267/137, 125, 140.1

[56] References Cited

U.S. PATENT DOCUMENTS

| | | | |
|---|---|---|---|
| 2,269,966 | 1/1942 | Wemp | 74/574 |
| 2,814,462 | 11/1957 | De Jarnett | 175/56 |
| 2,878,835 | 3/1959 | Peterson | 175/56 |
| 2,953,351 | 9/1960 | Bodine et al. | 175/56 |
| 3,190,422 | 6/1965 | Burckhardt | 74/574 |
| 4,173,130 | 11/1979 | Sutliff et al. | 175/321 |

*Primary Examiner*—James A. Leppink

*Assistant Examiner*—Hoang C. Dang

*Attorney, Agent, or Firm*—Edward A. Sokolski

[57] ABSTRACT

A sonic damper unit which is placed directly above a drill collar string to damp out unwanted complex wave vibrations of the string both longitudinal and lateral in vibration mode. The damper unit comprises a tubular section which is filled with small pieces of material trapped therein which may comprise pellets of metal, pebbles, ceramic, etc. A longitudinal channel may be formed within the tubular damper unit for transporting mud therethrough and to be mixed into the trapped pellets or the like. The damper unit is preferably located in a low impedance region of the standing wave pattern formed in the string some distance from the bit, e.g. the top of the drill collar string. The pellets are capable of motion in a random pattern and thus effectively respond to the frequency content of complex vibrational wave modes both lateral and longitudinal and effectively damp out any such unwanted vibrational energy which may appear in the drill collar string.

9 Claims, 2 Drawing Figures

METHOD AND APPARATUS FOR DAMPING VIBRATIONS IN DRILL COLLAR STRINGS

Figure 1:
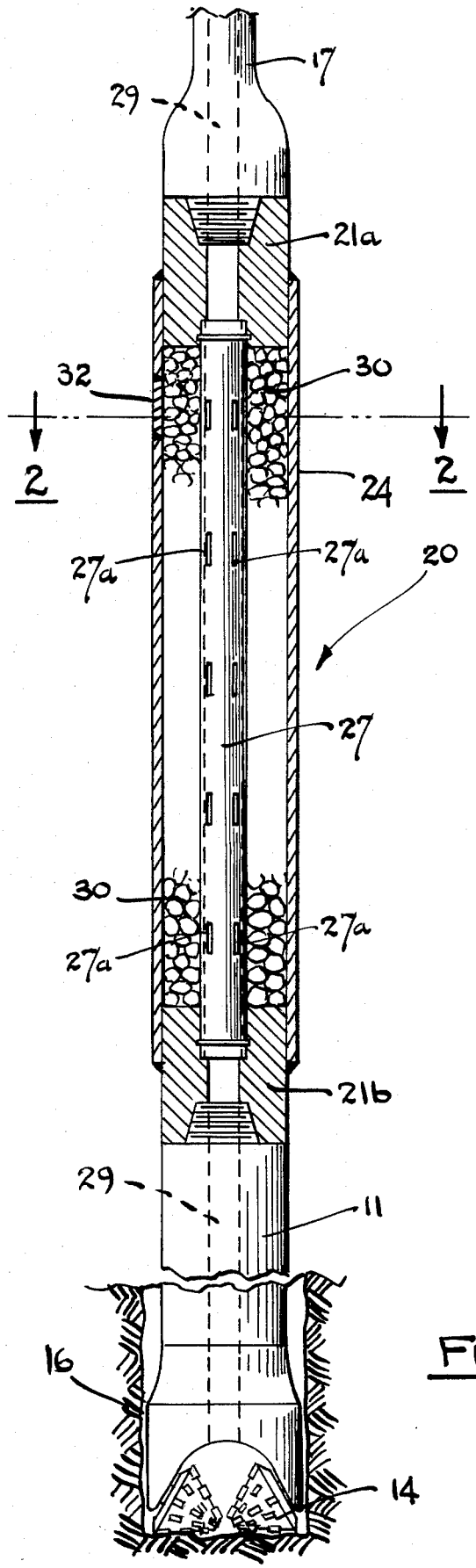

This invention relates to drill strings employed in well drilling, and more particularly to a method and apparatus for damping out unwanted vibrational elastic wave energy which may appear in a drill collar string.

As described in my U.S. Pat. No. 2,953,351, issued Sept. 20, 1960, in the operation of a conventional drilling bit designed for operating on relatively irregular formations, undesirable low-frequency vibratory energy is often developed which can cause serious damage to the drilling bit and the associated equipment. This unwanted vibratory energy can become particularly destructive if a resonant wave condition is reached at which the amplitude of vibration increases markedly. The device of my aforementioned patent was directed particularly to damping sinusoidal vibratory energy immediately above the drill bit and having a vertical mode of vibration. With the system of my U.S. Pat. No. 2,953,351, such vertical vibration was effectively damped at the source by employing a massive sleeve member which surrounded the drill stem between the bit and the bottom of the drill collar string, this sleeve being provided at its lower end with an impact shoulder which is adapted to periodically strike the sleeve shoulder to effectively suppress the undesired vibration at its point of origin.

With higher bit loadings and speeds, and in operating on harder formations in marginal or deeper wells, the simple sinusoidal longitudinal wave vibration commonly encountered in the past is no longer the case, but a complex elastic wave vibration having both lateral and longitudinal modes contained therein is now encountered. This problem is discussed in an article which appeared in the *Oil and Gas Journal* edition of June 6, 1983, vol. 81, no. 23, p. 63, in an article by Don W. Dareing, entitled "Rotary Speed Drill Collars Control Drill String Bounce." The vibration encountered in such situations has both longitudinal and lateral vibration, as well as cross coupling between such modes and results in a highly complex vibrational wave pattern in the drill collar, the various vibration waves having a variety of phase relationships between each other. The system of my U.S. Pat. No. 2,953,351 pattern is therefore incapable of effectively damping out this complex vibrational energy encoutered in many modern day situations.

The present invention is directed towards providing means for effectively damping out complex vibrational wave modes having both lateral and longitudinal vibration encountered in drill collar strings, particularly in the drilling of deep wells and where harder formations are encountered.

The drill collar string generally used is a moderately long column of thick walled tubes directly above the drill bit, these tubes typically being in sections which are joined together to provide the necessary length. The drill collar string in a typical situation has a length of about 400 feet and a weight per linear foot of 5–10 times of that of the thousands of feet of drill string connected thereabove. Any complex wave pattern in the drill collar assembly thus has good acoustic reflection and low impedance at the top juncture with the drill pipe. The drill collar string provides the necessary down weight which forces the drill bit against the formation as it is rotated by the long drive shaft action of the drill pipe. With the rotation of the drill bit against the formation, and with squeaking contact of the drill collars against the bore hole, strong acoustical vibrations are set up in the drill collar string, these vibrations having a multitude of fundamental, harmonic and overtone vibrational wave patterns which are both longitudinal and lateral in mode. At certain frequencies, this vibrational energy tends to set up resonant or ringing vibration of the drill collar string which can develop destructive forces to both the drill string and the bit. The present invention is directed to the damping of the vibratory patterns which appear in the drill collar string by effectively reducing the acoustical "Q" of the drill collar so that this tendency to "ring" is either entirely eliminated or at least substantially reduced. This damping is best provided at a location away from the drill bit, preferably in the low impedance region between the drill collar string and the relatively light drill pipe.

In achieving the desired end results, the system of the invention employs a tube section which is filled with dense pieces or pellets which may be of a metallic, ceramic, or other such material providing a mass reactance to the vibrational energy. In the preferred embodiment, an inner tube member is provided within the jacket or outer tube member for conveying mud down the drill string to the bit and also laterally to the pellets to aid in their damping action. The damper member of the present invention is located at a region of relatively low acoustical impedance so that it can more efficiently receive and absorb the vibratory energy.

It is therefore an object of this invention to provide means for damping out unwanted vibrational energy which may appear in a drill collar string.

It is a further object of this invention to prevent damage to drill bits and drill strings due to vibrational energy developed in drilling.

It is still a further object of this invention to prevent the resonant vibration of a drill collar string occasioned by vibrational forces generated in drilling.

Figure 2:
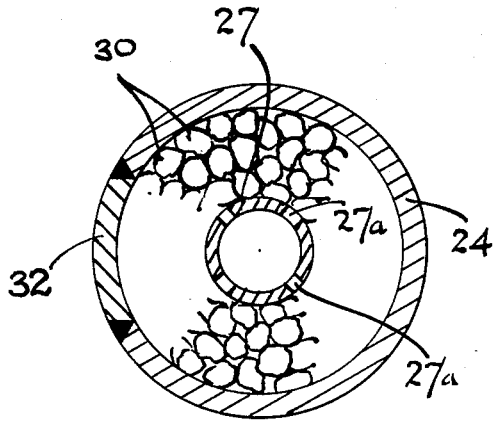

Other objects of this invention will become apparent as the description proceeds in connection with the figures of which:

FIG. 1 is a cross-sectional view in elevation of an embodiment of the invention; and FIG. 2 is a cross-sectional view taken along the plane indicated by 2—2 in FIG. 1.

Referring to the figures, the drill collar string 11 of a drill for drilling a well, such as an oil well, is connected to a drill bit 14 which is being employed to drill in earthen formation 16. A drill pipe 17 is rotatably driven to provide the rotary drilling action. Interposed between drill pipe 17 and drill collar string 11 is a damper unit 20 of the present invention. The damper unit 20 is threadably attached to drill pipe 17 and to drill collar string 11 by means of threaded attachment members **21*a* and 21*b*, respectively. The damper assembly includes a tubular jacket 24 to which attachment members 21*a* and 21*b* are welded. Running through the center of jacket 24 is a tubular conduit 27 which has perforation slots 27*a* formed therein. Conduit 27 is in fluid communication with channel 29 which runs to the drill bit and through which mud is pumped for washing up the cuttings and for cooling the drill. A portion of this mud is forced through slots 27*a* into the regions surrounding conduit 27. In the space between conduit 27 and the inner wall of jacket 24, pieces of a material, such as lead pellets, 30 are contained, these pellets being placed inside the jacket through a window 32, this window being sealed shut after the jacket has been filled with such pellets. It is to be noted that pellets 30 may be of a variety of different high density materials, such as for example, lead, brass, steel, ceramic, stone pebbles, etc. These pellets also may be of various shapes and sizes and neet not be uniform. Random shape and impact is sometimes desirable. A typical embodiment of the invention would employ round lead pellets having a diameter of the order of ¼" to 2". Also, in order to present good total mass of inductive reactance, the body of pellets 30 should have a vertical length at least three times the diameter of jacket 24**.

In operation, should there be vibrational energy developed in drill collar string 11, this energy will be transferred from the inner ends of 21*a* and 21*b* and through jacket 24 to pellets 30 which in response to the vibrational energy will be caused to strike each other in random directions. This random motion of pellets 30 will tend to dissipate the vibrational energy under what is sometimes called critical damping conditions, thereby tending to prevent a resonant effect or large amplitude vibration from starting or from being set up in the drill collar string. In view of the relatively loose packing of the pellets within the jacket, such pellets are free to move in a variety of directions and thus can respond to a variety of complex vibrational modes, thereby being capable of effectively dissipating such complex vibrational energy. The mud mixed with the pellets further aids the damping action through the viscous impedance it provides to the motion of the pellets. In addition to viscous and other resistive impedance, the mass of pellets presents an inductive reactance of random phase which is good for critical damping.

While the invention has been described and illustrated in detail, it is to be clearly understood that this intended by way of example and illustration only and is to be taken by way of limitation, the spirit and scope of the invention being limited only by the terms of the following claims.

We claim:

1. In a drill assembly having a drill bit collar string connected to the drill bit pipe for use in rotatably driving the drill collar string and bit, the improvement being means for damping vibratory energy developed in the drill collar string comprising:

an elongated jacket member connected to the drill collar string at a region thereof away from the bit having low accoustical impedance, means for continually providing fluid communication between the interior of said jacket member and the ambient environment to facilitate the damping and, separate pieces of mass reactive material installed within said elongated jacket for limited freedom of motion both longitudinally and laterally relative to each other and to the walls of the jacket, vibratory energy developed in the drill collar string being transferred to said pieces of material causing said pieces to randomly strike against each other thereby dissipating said energy.

2. The drill assembly of claim 1 wherein the pieces of material are in the form of pellets.

3. The drill assembly of claim 2 wherein the jacket member is substantially filled with said pellets.

4. The drill assembly of claim 2 wherein the pellets are of lead.

5. The drill assembly of claim 1 wherein the jacket member is connected in said assembly between the drill collar string and the drill pipe.

6. The drill assembly of claim 1 and further including means for feeding mud to said jacket member such that the mud mixes with said pieces of material.

7. The drill assembly of claim 6 wherein said means for feeding mud to said jacket member comprises a perforated tube member installed in the jacket member and means for feeding mud to the tube member, said perforated tube member further comprising said means for providing fluid communications between the interior of the jacket member and the ambient environment.

8. A method for damping out unwanted vibrartory energy developed in the drill collar string of a drill assembly having a drill pipe for use in driving the drill collar string comprising:

filling a jacket member with pieces of mass material so that such pieces are free to move laterally and longitudinally relative to each other and to the jacket member, continually providing fluid communication between the interior of the jacket member and the ambient environment to facilitate the damping and connecting said jacket member between the drill collar string and the drill pipe in a region of low acoustical impedance.

9. The method of claim 8 and further including flowing mud to said jacket member for mixture with the pieces.

* * * * *